US006675874B2

(12) United States Patent
Mast et al.

(10) Patent No.: US 6,675,874 B2
(45) Date of Patent: Jan. 13, 2004

(54) HEAT PIPE SYSTEM FOR COOLING FLYWHEEL ENERGY STORAGE SYSTEMS

(75) Inventors: Brian E. Mast, Lancaster, PA (US); Nelson J. Gernert, Elizabethtown, PA (US); James E. Lindemuth, Lititz, PA (US)

(73) Assignee: Thermal Corp., Stanton, DE (US)

( * ) Notice: Subject to any disclaimer, the term of this patent is extended or adjusted under 35 U.S.C. 154(b) by 36 days.

(21) Appl. No.: 10/185,842

(22) Filed: Jun. 27, 2002

(65) Prior Publication Data

US 2003/0000683 A1 Jan. 2, 2003

Related U.S. Application Data

(60) Provisional application No. 60/302,079, filed on Jun. 29, 2001.

(51) Int. Cl.[7] ..... F28D 1/00
(52) U.S. Cl. ..... 165/45; 165/104.26
(58) Field of Search ..... 165/104.26, 185, 165/45

(56) References Cited

U.S. PATENT DOCUMENTS

| | | | | |
|---|---|---|---|---|
| 3,902,547 A | * | 9/1975 | Waters | 165/45 |
| 4,162,701 A | | 7/1979 | Ollendorf | |
| 4,388,964 A | | 6/1983 | Almgren et al. | |
| 5,219,020 A | * | 6/1993 | Akachi | 165/104.26 |
| 5,705,018 A | | 1/1998 | Hartley | |
| 5,927,094 A | | 7/1999 | Nickum | |
| 6,076,595 A | * | 6/2000 | Austin et al. | 165/104.26 |
| 6,537,353 B2 | * | 3/2003 | Holst et al. | 96/108 |
| 6,595,269 B2 | * | 7/2003 | Mitchell | 165/86 |
| 2003/0056936 A1 | * | 3/2003 | Lindemuth et al. | 165/45 |

FOREIGN PATENT DOCUMENTS

| | | |
|---|---|---|
| EP | 0 779 436 A2 | 6/1997 |
| JP | 55095337 | 2/1982 |
| JP | 60133787 | 12/1986 |

* cited by examiner

*Primary Examiner*—Terrell McKinnon
(74) *Attorney, Agent, or Firm*—Duane Morris LLP

(57) ABSTRACT

A cooling system is provided for cooling a canister. A first heat pipe is mounted around the perimeter of the canister. The first heat pipe has a condenser. A second heat pipe has an evaporator conductively coupled to the condenser of the first heat pipe. The second heat pipe has a condenser. A heat sink is conductively coupled to the condenser of the second heat pipe.

13 Claims, 3 Drawing Sheets

HEAT PIPE SYSTEM FOR COOLING FLYWHEEL ENERGY STORAGE SYSTEMS

This application claims priority from copending Provisional Application Ser. No. 60/302,079, filed Jun. 29, 2001, and entitled HEAT PIPE SYSTEM FOR COOLING FLYWHEEL ENERGY STORAGE SYSTEMS.

FIELD OF THE INVENTION

The present invention relates to cooling systems generally, and more specifically to heat pipe systems.

BACKGROUND OF THE INVENTION

Flywheel systems are used for energy storage in backup power supplies (e.g., for telecommunication systems, server farms, etc.). Energy is stored in the angular momentum of the flywheel. The flywheel systems are typically stored inside silo canisters, which are buried in the ground. Typical prior-art flywheel systems dissipated a sufficiently small amount of waste heat that the silo could be cooled by passive conduction from the silo into the surrounding ground.

For example, U.S. Pat. No. 5,927,094, issued to Nickum, discloses a system for cooling electrical components, having a cooling apparatus, for use with an electronic device generating heat, such as a computer with a processor. In one embodiment, the cooling apparatus is thermally coupled with the heat producing component and has a flywheel, a means for converting the waste heat from the heat producing component into rotational movement of the flywheel, and a fan coupled with the flywheel. As the heat producing component generates heat, the flywheel and the fan are rotated. The rotating fan assists in moving air through the system and cools the system Newer flywheel systems dissipate too much power in the form of heat to cool the flywheels by conduction to the ground or convection to the air alone.

SUMMARY OF THE INVENTION

The present invention is a cooling system for cooling a canister. A first heat pipe is mounted around the perimeter of the canister, and includes a condenser. A second heat pipe has an evaporator conductively coupled to the condenser of the first heat pipe. The second heat pipe also includes a condenser, and a heat sink that is conductively coupled to the second heat pipe's condenser.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENTS

Figure 1:
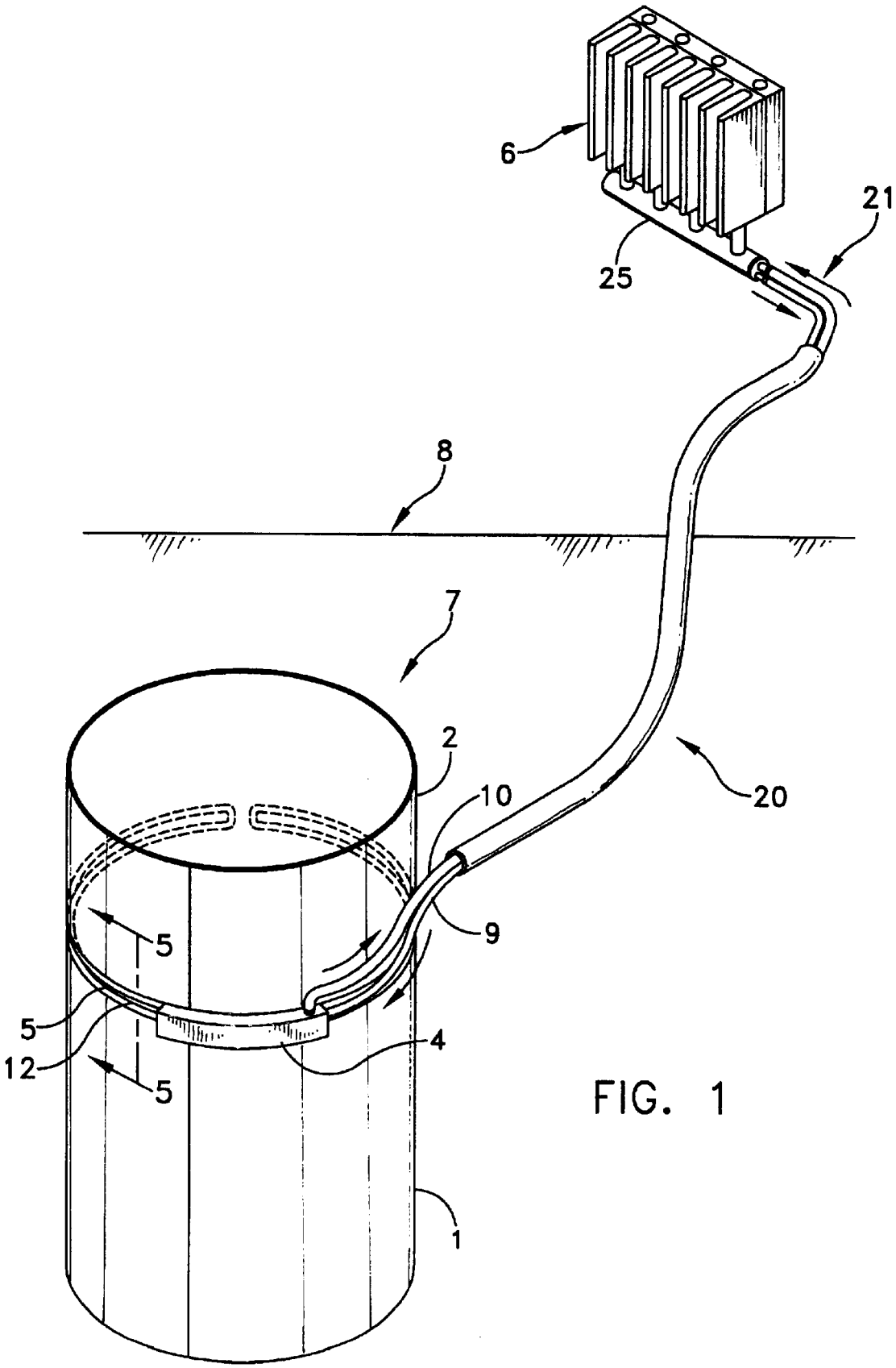
FIG. 1 is a perspective view, partially in phantom, of a cooling system for a flywheel energy storage system according to the invention.
Figure 2:
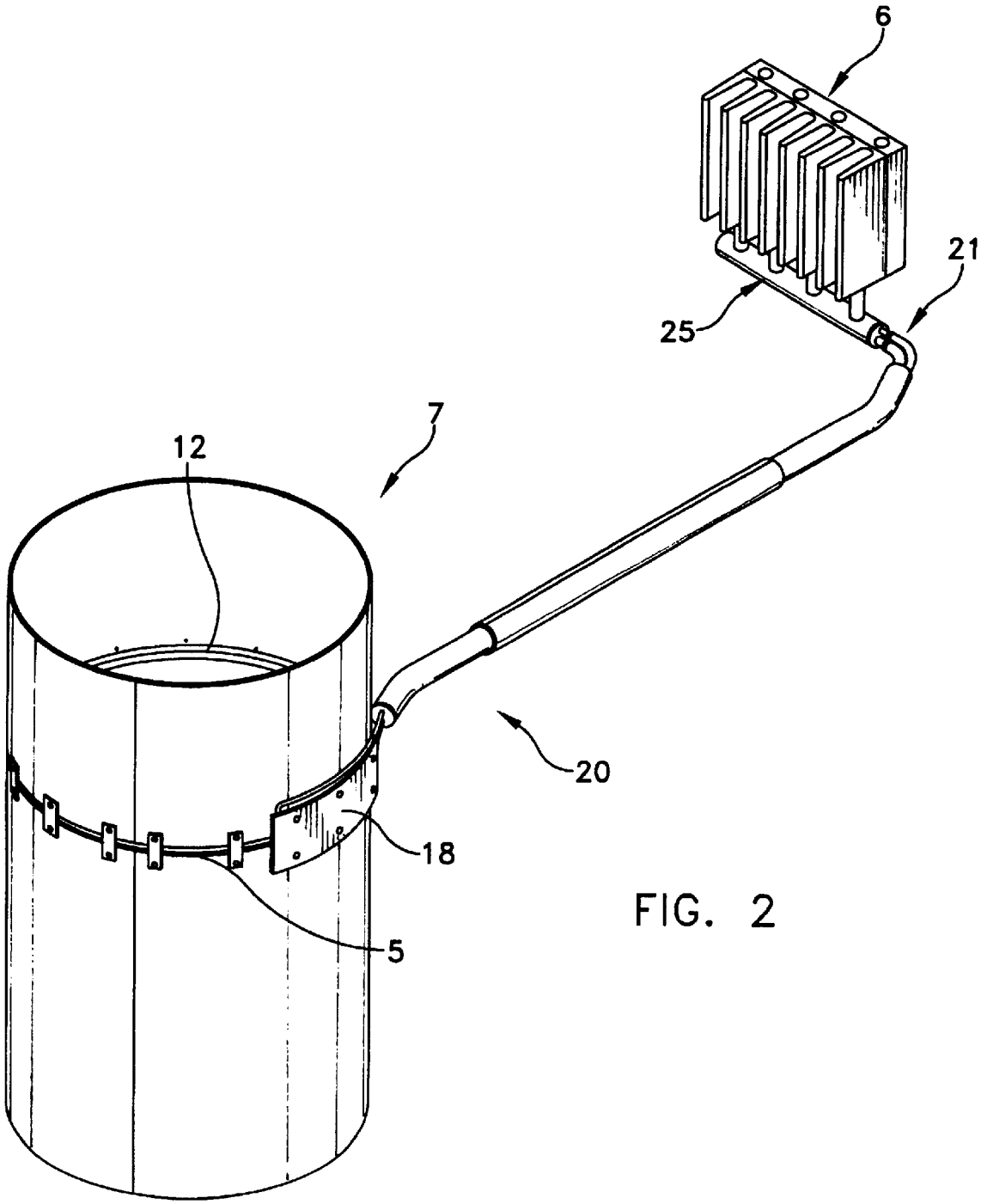
FIG. 2 is a further perspective view of the system of FIG. 1.
Figure 3:
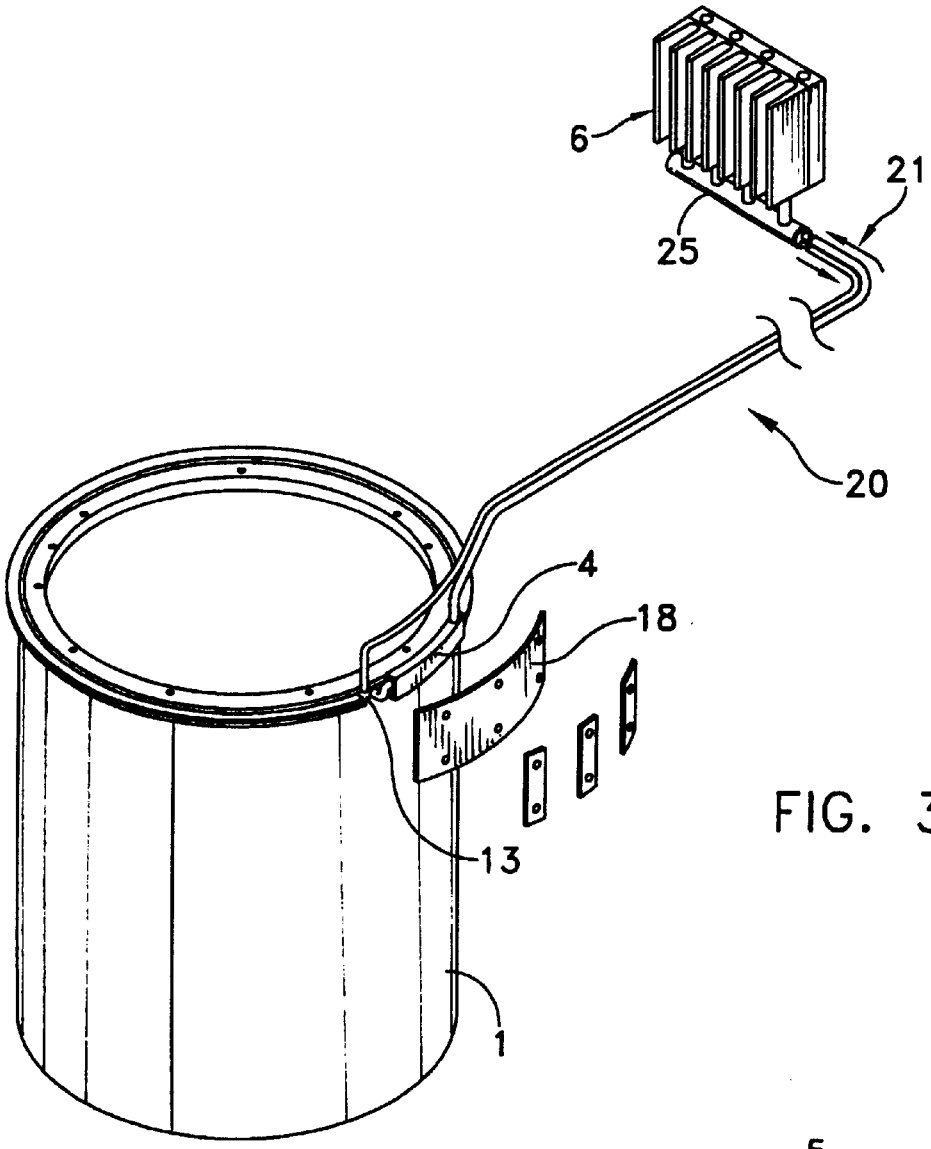
FIG. 3 is a partially exploded view of the assembly of FIG. 2.
Figure 4:
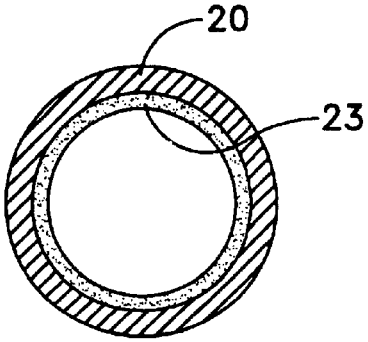
FIG. 4 is a cross-sectional view of a heat pipe used in connection with the present invention.
Figure 5:
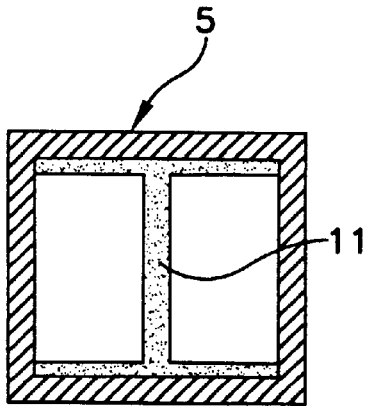
FIG. 5 is a cross-sectional view, as taken along lines 5—5 in FIG. 1, of another heat pipe used in connection with the present invention, having an I-beam shaped wick.

The present invention is a system 7 and method for cooling a canister 1, 2. Exemplary canister 1, 2 is the silo of a flywheel energy storage system (not shown). The flywheel (not shown) is encased within a vacuum enclosure (not shown) that mounts inside the aluminum silo 1, 2. System 7 is used to transport and dissipate waste heat generated in the flywheel system to the atmosphere. In the example, silo 1 is typically buried two to eight feet below ground level 8, but system 7 may be used for above ground flywheel system generally and above ground canisters generally. Further, system 7 may be used for cooling any object having at least one circular cross section, regardless of whether the object is hollow or solid.

The exemplary system 7 comprises two heat pipe assemblies. A circular heat pipe 5 is mounted on the outer circumference or periphery of the canister 1, 2. Heat pipe 5 may have, for example, a circular cross-section for a toroidal heat pipe, or a rectangular cross section for an annular heat pipe. The exemplary toroidal heat pipe 5 has a three layer I-beam shaped wick 11, which may be for example a screen mesh wick. The wick extends throughout the entire length of the heat pipe 5 (i.e., the complete circumference of the silo 1, 2). Other wick cross sections and materials may be used, such as a conventional annular or cylindrical wick with grooves along the wall of the envelope. An exemplary working fluid for the toroidal heat pipe 5 is methanol, but other working fluids (e.g., ethanol or other alcohol, water, freon) may be used.

Heat pipe 5 may be mounted in a groove 12 on the exterior of silo 1, 2. In the exemplary embodiment, the thermal interface between toroidal heat pipe 5 and silo 1, 2 is formed using a thermally conductive material, such as thermally conductive epoxy, thermal grease, solder or the like (which may be of a conventional composition) inside groove 12. The evaporator of heat pipe 5 comprises all of heat pipe 5 except a small arc 13 that is adjacent to an evaporator 4 of a second heat pipe 20. Small arc 13 of heat pipe 5 serves as a condenser section for heat pipe 5. Preferably, the number of degrees of arc of evaporator portion of heat pipe 5 is as large as possible, e.g., nearly 350 degrees or so, subject to the constraint that the remaining arc (i.e., the condenser section 13 of heat pipe 5) is sufficiently lengthy so as to conduct the expected amount of heat to be dissipated to evaporator 4 of second heat pipe 20.

Second heat pipe 20 joins toroidal heat pipe 5 at condenser section 13 of heat pipe 5, i.e., at evaporator section 4 of second heat pipe 20. Thermal grease, or the like, may be included at the interface between heat pipes 5 and 20 to enhance thermal conduction between condenser section 13 and evaporator 4. The exemplary second heat pipe 20 often comprises a thermosyphon assembly 21. Thermosyphon assembly 21 uses a heat pipe 20, but relies upon gravity to return fluid from a condenser 25 to evaporator 4. Second heat pipe 20 transports the heat energy to above ground 8, where the heat can be dumped into the ambient air, via convention through heat sink 6. The wick structure 23 of heat pipe 20 is provided in evaporator 4, and may be formed of sintered powder. Other wick structures, such as screen mesh, may be used. The working fluid of exemplary thermosyphon 21 including heat pipe 20 is methanol, but other working fluids may be used.

Other types of heat pipes may be used to transport the heat from the toroidal heat pipe 5 to above ground. For example, a conventional heat pipe having a single envelope that transports both vapor (upwards) and liquid (downwards) may be used.

In the exemplary embodiment, no special heat exchanger is required between the condenser of toroidal heat pipe 5 and the evaporator 4 of heat pipe 20. All of the heat in toroidal heat pipe 5 collects in condenser region 13, which is adjacent to evaporator 4. The heat is transferred by conduction from condenser 13 of toroidal heat pipe 5 to evaporator 4 of heat pipe 20. A protective plate 18 may be provided for shipping protection. Plate 18 is not needed when the system 7 has been installed, and may be removed once the system is placed below ground.

In the exemplary system, the four-tube multiple condenser 25 of thermosyphon 21 is attached to heat sink 6, which may be a folded or extruded finstack, or other set of fins, formed from aluminum or other suitable, highly thermally conductive metal. The heat may be rejected by heat sink 6 to the atmosphere by natural convection. Alternatively, forced convection may be used. An exemplary system transports 60 Watts of power from the flywheel system, with a temperature difference of about 10 degrees centigrade between the silo 1, 2 and the ambient temperature. Other power levels and/or temperature differences are also contemplated.

The heat pipe systems 5, 20 operate passively, eliminating maintenance and reliability concerns. This makes the exemplary system 7 advantageous for use in areas that are remote from maintenance workers.

Although the exemplary embodiment is designed to fit around a circular canister 1, 2, the first heat pipe may be selected to conform to the shape of the outer periphery of any canister, whether circular, elliptical, rectangular, or other shape.

It is to be understood that the present invention is by no means limited only to the particular constructions herein disclosed and shown in the drawings, but also comprises any modifications or equivalents within the scope of the claims.

What is claimed is:

1. A system for cooling a canister, comprising:

a first heat pipe mounted around said perimeter of said canister, said first heat pipe having a condenser;

a second heat pipe having an evaporator thermally conductively coupled to said condenser of said first heat pipe, said second heat pipe having a condenser;

a heat sink conductively coupled to said condenser of said second heat pipe.

2. The system of claim 1 wherein said canister is at least partially buried below ground, and said first heat pipe is positioned entirely below ground.

3. The system of claim 2 wherein said heat sink is positioned above ground.

4. The system of claim 1 wherein said canister has a circular cross section at a height at which said first heat pipe is located, and said first heat pipe is annularly disposed on said canister.

5. The system of claim 4 wherein said first heat pipe has a toroidal shape.

6. The system of claim 5 wherein said first heat pipe has an I-beam-shaped wick.

7. The system of claim 6 wherein said wick of said first heat pipe extends throughout said first heat pipe.

8. The system of claim 4 wherein said canister has a groove extending throughout a circumference thereof, and said first heat pipe is mounted in said groove.

9. The system of claim 1 wherein said second heat pipe comprises a portion of a thermosyphon.

10. The system of claim 9 wherein said second heat pipe has a wick that is located substantially within said evaporator of said second heat pipe.

11. The system of claim 10 wherein said wick of said second heat pipe is formed of sintered powder.

12. The system of claim 1 wherein said canister is at least partially buried below ground, and said first heat pipe is positioned entirely below ground;

said heat sink is positioned above ground; said canister has a circular cross-section at a height at which said first heat pipe is located, and said first heat pipe is toroidal;

said first heat pipe has an I-beam-shaped wick that extends throughout said first heat pipe; and said canister has a groove extending throughout a circumference thereof, and said first heat pipe is mounted in said groove.

13. The system of claim 1 wherein said second heat pipe is a thermosyphon having a wick formed of sintered powder that is located substantially within said evaporator of said second heat pipe.

* * * * *